US005551198A

United States Patent [19]

Schaaf et al.

[11] Patent Number: 5,551,198

[45] Date of Patent: Sep. 3, 1996

[54] SOUND COLLECTING BLOCK AND SOUND ABSORBING WALL SYSTEM

[76] Inventors: Cecil F. Schaaf, 3015 Palmer Rd., Standish, Mich. 48658; Craig R. Schaaf, 741 Crawford St., Flint, Mich. 48507

[21] Appl. No.: 438,229

[22] Filed: May 9, 1995

[51] Int. Cl.[6] ..... E04B 1/82

[52] U.S. Cl. ..... 52/604; 52/605; 52/607; 52/144; 181/285; 181/288

[58] Field of Search ..... 181/288, 285; 52/604, 606, 144, 563, 564, 605, 607

[56] References Cited

U.S. PATENT DOCUMENTS

| | | | |
|---|---|---|---|
| 3,222,830 | 12/1965 | Ivany | 52/607 X |
| 3,315,427 | 4/1967 | Frye | 52/607 X |
| 3,866,001 | 2/1975 | Kleinschmidt et al. . | |
| 4,018,018 | 4/1977 | Kosuge | 52/607 X |
| 4,071,989 | 2/1978 | Warren | 181/285 X |
| 4,439,967 | 4/1984 | Dielenberg | 52/607 X |
| 4,562,901 | 1/1986 | Junger et al. | 181/285 |
| 4,573,301 | 3/1986 | Wilkinson | 52/607 |
| 4,597,236 | 7/1986 | Braxton | 52/606 X |
| 4,964,486 | 10/1990 | D'Antonio et al. | 181/288 X |
| 5,193,318 | 3/1993 | D'Antonio et al. | 181/285 X |
| 5,226,267 | 7/1993 | D'Antonio et al. . | |
| 5,457,926 | 10/1995 | Jensen | 52/604 |

FOREIGN PATENT DOCUMENTS

| | | | |
|---|---|---|---|
| 2452373 | 5/1976 | Germany | 52/605 |

*Primary Examiner*—Wynn Wood
*Attorney, Agent, or Firm*—Robert L. McKellar

[57] ABSTRACT

This invention deals with novel sound collecting blocks and their use, in conjunction with novel connector blocks, to build inexpensive, decorative sound walls. This invention also deals with retaining walls which are constructed from the novel connector block, and other non-sound absorbing solid blocks.

10 Claims, 3 Drawing Sheets

SOUND COLLECTING BLOCK AND SOUND ABSORBING WALL SYSTEM

This invention deals with novel sound collecting blocks and their use, in conjunction with novel connector blocks, novel turning blocks, and novel post blocks, to build inexpensive, decorative sound walls. This invention also deals with retaining walls which are constructed from the novel connector block and the other non-sound absorbing solid blocks. Further, this invention deals with fire walls and their construction. All of the construction using the blocks of this invention is essentially mortarless.

More specifically, this invention deals with certain specific sound collecting blocks that when used in combination with connector blocks, and other solid building blocks, are useful to build sound absorbing walls and systems, fire walls, retainer walls, and cribbing that are stable, strong, durable, decorative and useful.

The sound collecting block is fabricated from a solid molded structural material and has a plurality of vertical slots which communicate with a horizontal notch to collect sound and disperse it to the interior of a wall for absorption.

The theory postulated by the inventors herein is that the large amount of opening in the face of the sound collecting block allows for a greater amount of sound to penetrate into the large chambers formed by the wall. Further, the fiberglass batting that is used in the interior of the wall absorbs the sound. The inventors herein believe that the sound waves are converted to heat energy by this system, which heat is dissipated within the environs of the interior of the wall.

The connector block is fabricated from solid molded structural material and functions to lock together the sound collecting block and any desired back block to form a wall which is a sound absorption system.

Further, the connector block can be used within the scope of this invention to build a stable retainer wall, fire wall, by connecting together a front and a back block which are fabricated from solid molded structural material. The retainer wall for purposes of this invention can have sound absorbing properties, in which case, the wall is fabricated in part from sound collecting blocks described above, and solid blocks as disclosed herein.

FIELD OF THE INVENTION

The principal objective of this invention is to provide a sound absorbing system which can take the configuration of a wall and which can be used to deaden the sound in an area. Such a sound, for example can be from expressway traffic.

In addition, the wall must not only be capable of providing sound absorption, but it must be aesthetically pleasing, the wall must be stable to wind and the other elements, the wall must be capable of being easily constructed, taking into account the possible configurations that are required to place the wall on side hills, and the like. The simplicity of construction of the walls of this invention allow for the use of unskilled labor. One must be able to conveniently use stabilizers for the wall, such as iron rod and concrete posts.

A second objective of this invention is to provide a retaining wall which may or may not be used for sound absorption, but must be stable, strong, aesthetically pleasing, and easily constructed.

Finally, the blocks of this invention can be used to construct cribbing for shoring up river and lake embankments.

THE PRIOR ART

The applicant is aware of certain patents that describe sound absorbing blocks for use in constructing walls for sound absorbing purposes. It should be noted by those skilled in the art that such patents deal with sound absorbing blocks per se, and not with sound collecting blocks as is disclosed in this invention, the difference being that one using the sound absorbing blocks of the prior art have to depend on the physical characteristics of the blocks to provide sound absorption, while the blocks which are described and claimed herein are used as sound collecting blocks, and only in the event that they are used in constructing a sound absorbing system, such as a wall described and claimed herein, can any benefit be realized with the sound collecting blocks of this invention.

D'Antonio et al, in U.S. Pat. No. 5,226,267, issued Jul. 13, 1993, and U.S. Pat. No. 5,193,318, issued on Mar. 16, 1993, disclose acoustical diffusing and absorbing cinder blocks in which there is disclosed a block providing a plurality of wells and surface irregularities formed in the blocks to provide a flat power spectrum and constant scattered energy in the diffraction directions described therein. These blocks also include low frequency sound absorbing chambers.

These blocks differ from the blocks of the instant invention, in that, the blocks of the instant invention do not contain concavities of the type described by D'Antonio, and the blocks of this invention do not have surface irregularities such as are described and disclosed in the D'Antonio references.

Another block that is sound absorptive can be found in U.S. Pat. No. 4,562,901, issued Jan. 7, 1986 to Junger et al. This reference deals with a sound absorptive structural block with sequenced cavities in which the degree of sound absorption is based on the volume of open space within the block. This block differs from the sound collecting block of the instant invention in that the sound collecting block of the instant invention does not have any open areas in its configuration, it is a solid block.

Finally, there is disclosed in U.S. Pat. No. 3,866,001, issued Feb. 11, 1975, to Kleinschmidt, et al, a sound absorbing structural block with a septum, which septum divides the open area of the block into two different volumes. This block differs from the block of the instant invention in that it depends on the open areas internal of the block for its sound absorbing qualities, while the block of the instant invention is a solid block, not having any open areas in it.

THE INVENTION

In one aspect, the invention described herein deals with a novel sound collecting block that is useful for constructing sound absorbing walls and systems.

Specifically, the invention described herein deals with a novel sound collecting block of solid molded structural material having a front surface which has a horizontal midline, a rear surface, two essentially identical end surfaces, a top surface, and a bottom surface, it being understood that the reference to the midline herein is for clarification of the discussion herein and the blocks do not have an actual midline as part of the construction of such blocks.

The top surface has a planar notch located in it, which notch extends from the front surface to the rear surface of the block.

In addition, the sound collecting block contains a plurality of vertical slots extending between the front surface and the rear surface. The vertical slots also extend from about the horizontal midline of the front surface to open communication with the planar notch.

Each of the end surfaces has a vertical midline, and located at the vertical midline there is a vertical well which extends between the top surface and the bottom surface of the block.

Another aspect of this invention is a novel connector block. The connector block has two essentially identical end walls and two identical side walls which are formed contiguously to provide a central open chamber in the connector block.

The side walls have a top surface with a midpoint and they also have an inner surface and an outer surface. The side walls also have a bottom surface.

Each of the side walls has a groove through its top surface, at about its midpoint, extending between the inner surface and the outer surface.

The outer surface of each side wall has two vertical wells in it. The wells are located essentially equidistant from the midpoint of the top surface and near the end walls of the connector block and extend between the bottom surface of the sidewall and the top surface of the sidewall.

Yet another aspect of this invention is a sound absorbing wall segment and walls which are fabricated from such segments.

The sound absorbing wall segment comprises in combination a block (I) which is a front, sound collecting wall block. There is also included in the combination a block (II) of solid molded structural material as a back, non-sound collecting wall block, and a block (III), of solid molded structural material as a connector block to mechanically connect the front block and the back block together to provide a sound absorbing wall segment.

The connector block has two essentially identical end walls and two essentially identical side walls, all of which are contiguous so as to form a central open chamber in the connector block. Each side wall has a top surface with a midpoint and the side wall also has an inner surface and an outer surface and, a bottom surface.

Each side wall has a groove through its top surface, at about its midpoint, which extends between the inner surface and the outer surface of the side wall. The outer surface of each side wall has two vertical wells therein and each well is located equidistant from the midpoint of the top surface, and near the end walls of the connector block and extends between the bottom surface of the sidewall and the top surface of the sidewall.

Still another aspect of this invention is a retaining wall segment and walls fabricated from such retaining wall segments.

The retaining wall segment comprises in combination a block (A) of solid molded structural material as a front block, a block (B) of solid molded structural material as a back block and a block (C) as a connector block to connect the front block and the back block together to provide a retaining wall segment.

The connector block in this case is the connector described supra.

Yet another block of this invention is a turning block, which turning block comprises two essentially identical end walls with a top surface, a bottom surface, and a midpoint, and two essentially identical side walls, a middle wall with a top surface, which are formed contiguously to provide two central open chambers in the turning block.

The side walls have a top surface with a midpoint and an inner surface and an outer surface, and a bottom surface and each said side wall has a groove through its top surface, at about its midpoint extending between the outer surfaces of the side walls, and laying on the top surface of the middle wall.

The outer surfaces of each side wall have two small vertical wells therein, each said small vertical well located equidistant from the midpoint of the top surface and near the end walls of the turning block and extending between the bottom surface of the sidewall and the top surface of the sidewall and, each outer surface of each side wall has one large vertical well therein, each said large vertical well centered between the respective small vertical wells therein and extending between the bottom surface of the sidewall and the top surface of the sidewall and, each end wall has two end vertical wells therein, said end vertical wells being spaced apart and located near each other at the midpoint of the end wall so as to form a vertical column between them, each said end wall vertical column extending between the bottom surface of the end wall and the top surface of the end wall. This block provides the ability to turn corners when constructing a wall.

Finally, there is contemplated within the scope of this invention a post block, said post block comprising a symmetrical block having two essentially identical side walls and two essentially identical walls forming the right side and the left side, all of which are contiguously formed to provide a single chamber in the center. Each of the side walls have a vertical groove centered in its surface, which grooves extend from the bottom to the top of the block. The right and the left walls are essentially identical and have two narrow vertical wells in their surfaces, which are evenly spaced in the surface and which extend from the bottom surface to the top surface of the post block. This block provides for the building of vertical concrete posts into any wall structure, as the post block has the configuration to fit the construction of the wall and cement can be poured into the interior of the post block to provide a supporting post for the wall.

It is contemplated within the scope of this invention to use a combination of blocks from the sound absorbing segment and the retaining wall segment to achieve a wall having sound absorbing capabilities.

DETAILED DESCRIPTION OF THE INVENTION

Figure 1:
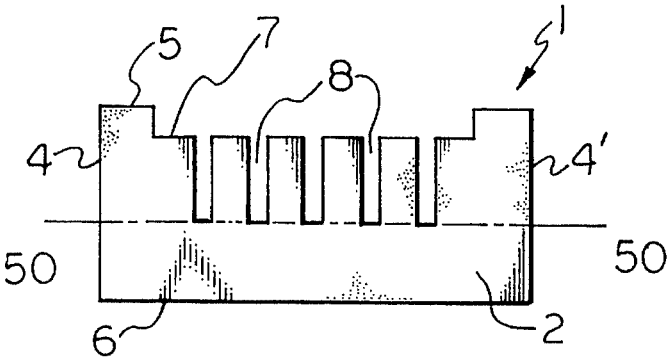
FIG. 1 is a full front view of the sound collecting block of this invention.

With reference to FIG. 1, there is shown a full front view of the sound collecting block 1 of this invention. The block is constructed of a solid molded structural material such as cement.

There is shown a front surface 2, which has a horizontal midline expressed by the line 50—50, it being understood that reference to a horizontal midline is for purposes of describing the invention only. With reference to both FIGS. 1 and 2, there is also shown a rear surface 3, two essentially identical end surfaces and 4', a top surface 5, and a bottom surface 6.

The top surface 5 has a planar notch 7 in it which extends from the front surface 2 to the rear surface 3, but does not extend from end surface 4 to 4'. The planar notch 7 allows for sound coming from the direction of the front of the sound collecting block 1 to move into the interior of the sound absorbing wall segment 23 described infra.

The sound collecting block 1 also contains a plurality of vertical slots 8 which extend between the front surface 2 and the rear surface 3. The vertical slots 8 also extend from about the horizontal midline 50—50 to the planar notch 7, and the vertical slots 8 openly communicate with the open planar notch 7. The planar notch 7 and the vertical slots 8 in combination provide for the accessibility of sound into the interior of the sound absorbing wall segment 23.

Figure 2B:
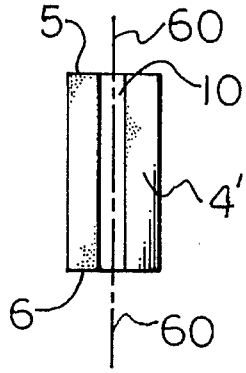
FIG. 2B is a full end view of FIG. 2A.
Figure 2A:
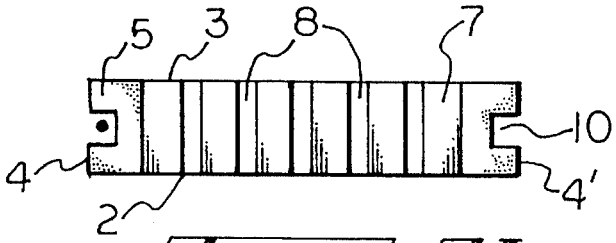
FIG. 2A is a full top view of FIG. 1.

Each of the end surfaces 4 and 4' have a vertical midline 60—60, shown in FIG. 2B and in FIG. 2A, at the left end of the Figure, wherein it is shown where the vertical midline 60—60 penetrates the planar surface of the drawing paper.

Located at the vertical midline 60—60 of each end is a vertical well 10 which extends between the top surface 5 and the bottom surface 6 of the sound collecting block 1.

Figure 3A:
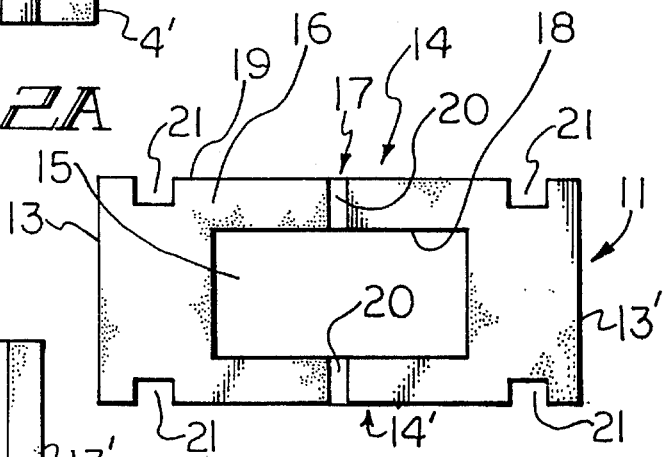
FIG. 3A is a full top view of the connector block of this invention.
Figure 4:
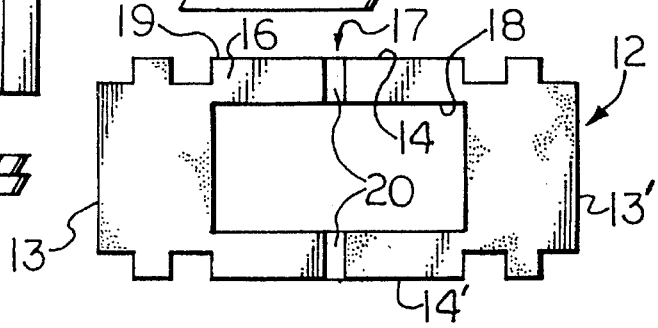
FIG. 4 is a full top view of another embodiment of the connector block of this invention.

With reference to FIGS. 3A and 4, there is shown top full views of the connector block 11 and another embodiment of the connector block 11, connector block 12, of the instant invention.

Figure 3B:
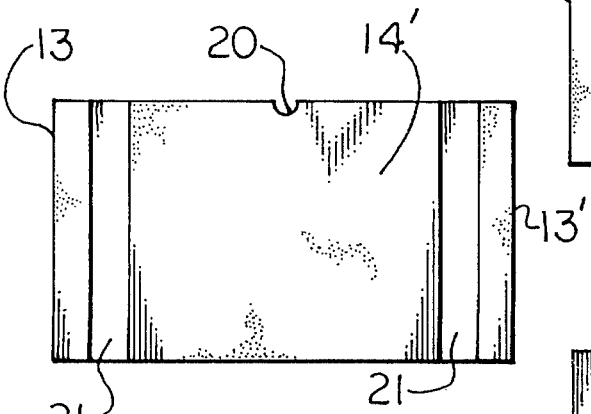
FIG. 3B is a full side view of FIG. 3A.

In addition with reference to FIG. 3B as well, connector block 11 has two essentially identical end walls 13 and 13' and two identical side walls 14 and 14' which are all formed in a contiguous manner to provide a central open chamber 15 in the connector block 11.

The side walls 14 and 14' have a top surface 16 with a midpoint 17 and an inner surface 18 and an outer surface 19. The side walls 14 and 14' also have a bottom surface 24 (FIG. 3B), and is identical in configuration to the top surface 16 of the connector block 11.

In addition, each side wall 14' and 14' have a groove 20 through the top surface 16 at about the midpoint 17, which groove 20 is shallow in depth to receive a reinforcing rod (not shown). Each groove 20 extends between the inner surface 18 and the outer surface 19.

The outer surface 19 of each side wall 14 and 14' has two vertical wells 21, the vertical wells 21 being located equidistant from the midpoint 17 of the top surface 16, and near the end walls 13 and 13' respectively of the connector block 11 The vertical wells 21 extend between the bottom surface 24 of the side walls 14 and 14' and the top surface 16 of the sidewalls 14 and 14'.

With regard to FIG. 4, there is shown another embodiment of the connector block 11, connector block 12. Connector block 12 is essentially identical to connector block 11 except that it has indentions 22 on its corners, which indentions extend from the top surface 16 to the bottom surface 24.

Figure 5:
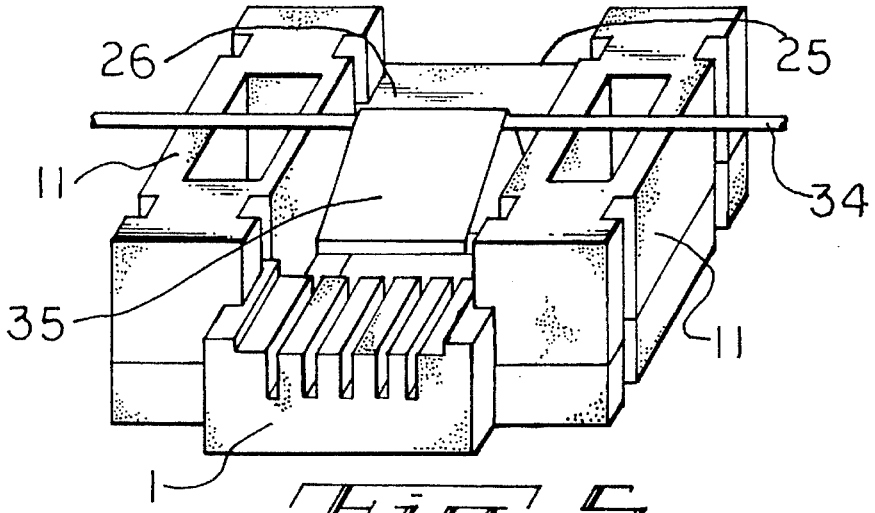
FIG. 5 is a front isometric view of a sound absorbing wall segment of this invention.

Turning now to FIG. 5, there is shown an isometric view of an inventive sound absorbing wall segment 23 comprised of a sound collecting block 1, two connector blocks 11 and a back wall block 25. The back wall block 25 is a solid block having vertical wells in its ends to allow it to engage with the connector blocks 11.

As can observed from FIG. 5, the wells as described in the blocks supra are used to receive and connect the various blocks together. The only significant criterion for the back wall block 25 is that it present a solid interior surface 26 to the sound absorbing segment 23. Shown in FIG. 5 is a steel reinforcing rod 34, which connects the wall together and helps reinforce the wall. Further shown is a segment of fiberglass insulation 35 draped over the steel rod 34. The fiberglass insulation 35 is draped over the steel rods 34 at each level of the wall construction, and in each chamber, in order to provide for the sound absorption therein. This manner of construction is easy and efficient and it is also efficient for sound absorption.

Figure 6:
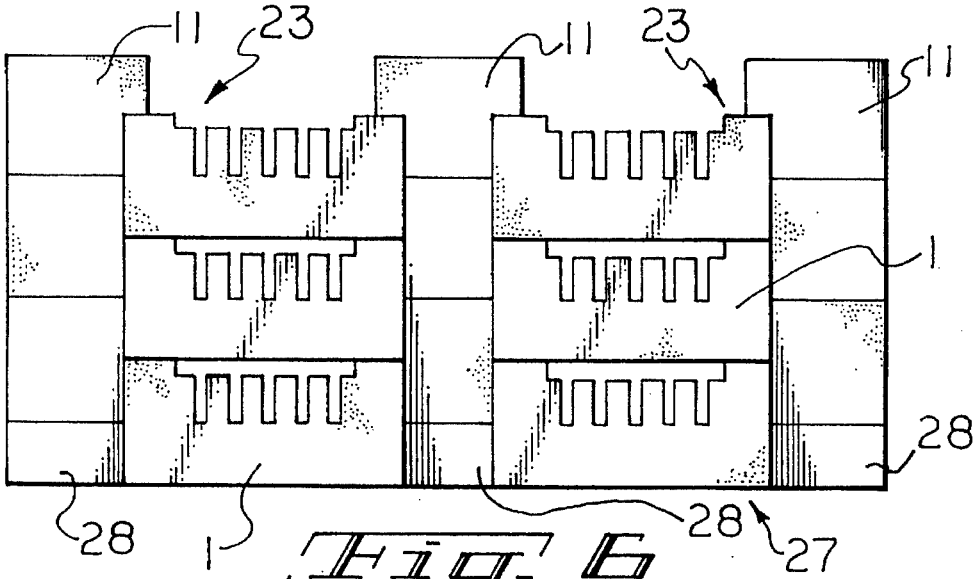
FIG. 6 is a full front view of a sound absorbing wall of this invention.

FIG. 6 shows a full front view of a sound absorbing wall 27, comprised of sound absorbing segments 23 in combination, with the back wall not visible in this view. It should be noted that a starter block 28 has been used to start the sound absorbing wall 27. It is also contemplated within the scope of this invention to start such a wall with the first line being an inverted sound collecting block 1.

For purposes of this invention, there should be as many vertical slots 8 as can be accommodated in the sound collecting block 1 without detracting from the strength of the block. A novel feature of the sound collecting block 1 is the fact that the block is solid so that a larger number of such vertical slots can be accommodated without detracting from the strength of the sound collecting block 1.

Another valuable feature of this sound collecting block 1 is the planar notch 7. This notch 7, in combination with the vertical slots 8 provides a means for a maximum penetration of sound to the interior of the sound absorbing wall segment 23 without detracting from the strength of the block itself.

Figure 7:
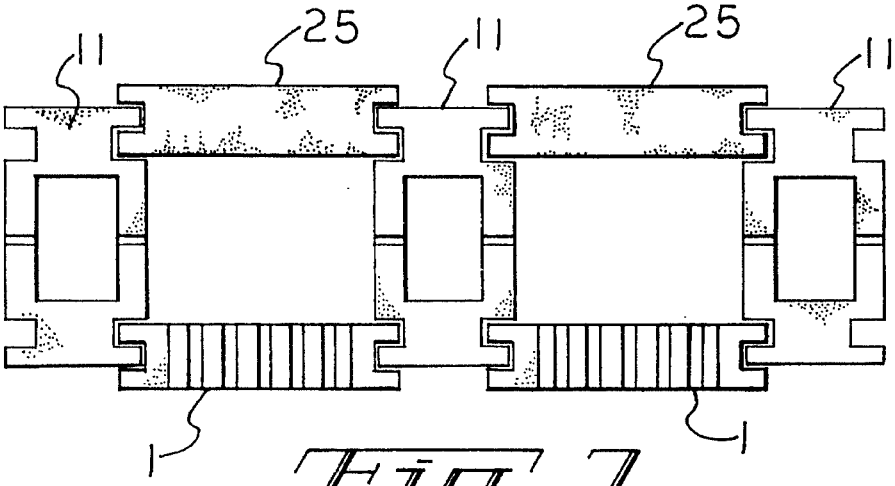
FIG. 7 is a full top view of FIG. 6.

Finally, with regard to the sound absorbing wall 27, FIG. 7 shows a full top view of such a wall with sound collecting blocks 1, connector blocks 11 and solid back wall blocks 25 all connected together.

Figure 8:
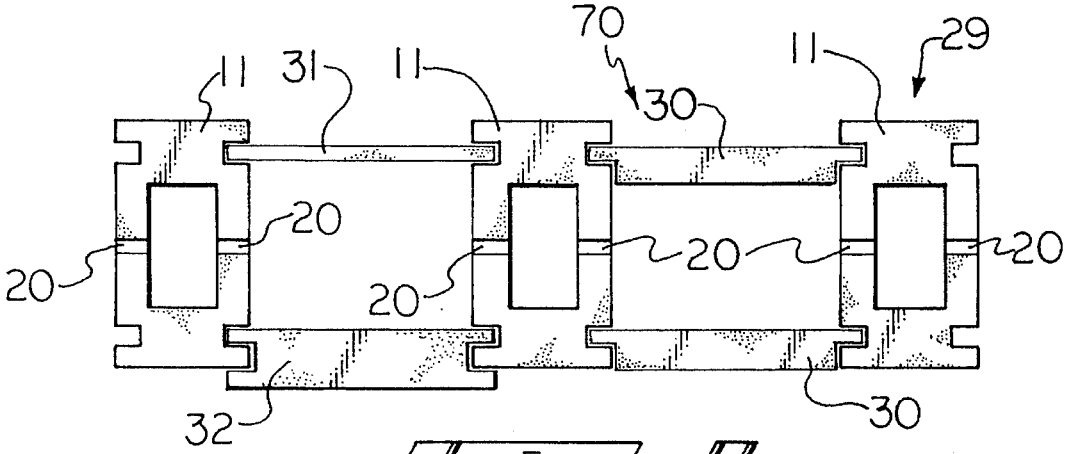
FIG. 8 is a full top view of a retaining wall of this invention showing the various solid blocks that can be used.

Turning now to the retainer wall segment 29, shown in FIG. 8, there is shown three connector blocks 11 connecting solid blocks 30, 31, and 32, all of which can be interchanged, one for the other, depending on which appearance that one desires to have in the front and back surfaces of the wall that is formed from such segments. For example, solid block 30 can be used when a flush wall design is desired, while block 31 gives an indented surface to the wall. Block 32 is the standard block for purposes of this invention, and emulates the size of the sound collecting block 1 such that these two blocks can be interchangeable to create a partial sound absorbing wall. It should be noted from FIG. 8 that the block 30 can be used in reverse order, such as at point 70 to create yet another design.

Grooves 20 provide a position for reinforcing rods 34 to be laid to enhance the stability of the wall. Further, any one, or all of the chambers 15 can be filled with concrete to create a solid concrete post, also for stability.

Figure 12:
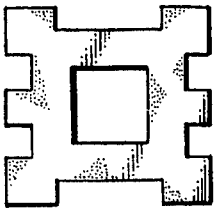
FIG. 12 is a top view of a post block of this invention.

A further means of stabilizing the walls of this invention is to use a number of the post blocks 36 in the construction (FIG. 12). Such post blocks 36 are spaced along and in the wall construction to provide a means of providing a concrete post. The post blocks can be filled with cement to provide such stabilization.

Figure 11:
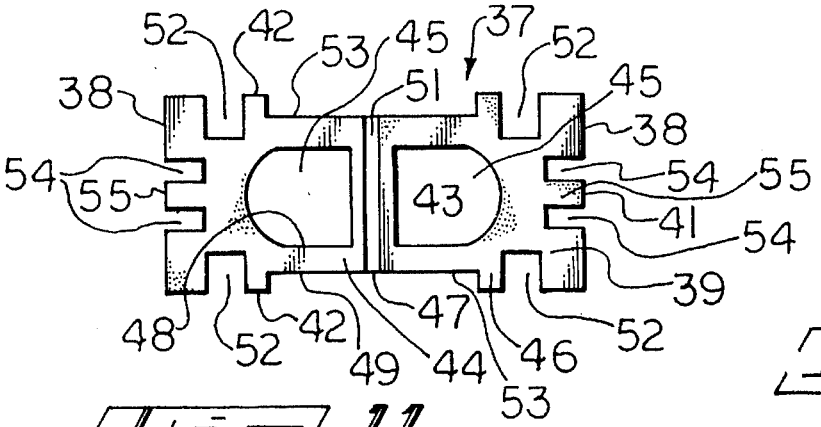
FIG. 11 is a top view of a turning block of this invention.

Finally, FIG. 11 shows a turning block 37 of this invention. The turning block 37 has two essentially identical end walls 38 with a top surface 39, a bottom surface 40 opposite the top surface 39, and being essentially identical to the top surface 39 (not shown), and a midpoint 41, two essentially identical side walls 42, and a middle wall 43 with a top surface 44, which walls 37 and 42 are formed contiguously to provide two central open chambers 45 in the turning block 37.

The side walls 42 have a top surface 46 with a midpoint 47 and an inner surface 48 and an outer surface 49, and a bottom surface 50, identical to the top surface 46, but not shown.

Each side wall 42 has a groove 51 through its top surface 44, at about its midpoint 47 extending between the outer surfaces 49 of the side walls 42, and laying on the top surface 46 of the middle wall 43.

The outer surface 49 of each side wall 42 has two small vertical wells 52 therein, said small vertical wells 52 located equidistant from the midpoint 47 of the top surface 46 and near the end walls 38 of the turning block 37 and extending between the bottom surface 50 of the sidewall 42 and the top surface 46 of the sidewall 42 and, each outer surface 49 of each side wall 42 has one large vertical well 53 therein, each said large vertical well 53 is centered between the respective small vertical wells 53 therein and extending between the bottom surface 50 of the sidewall 42 and the top surface 46 of the sidewall 42 and, each end wall 38 has two end vertical wells 54 therein, said end vertical well 54 being spaced apart and located near each other at the midpoint 41 of the end wall 38 so as to form a vertical column 55 between them, each said end wall vertical column 55 extending between the bottom surface 50 of the end wall 38 and the top surface 46 of the end wall 38.

Figure 9:
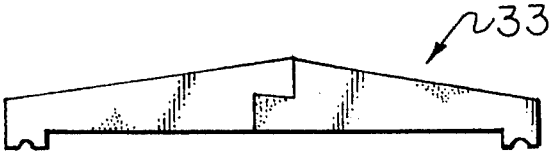
FIG. 9 is a full end view of a cap for the walls of this invention, wherein the cap is shown fully connected.
Figure 10:
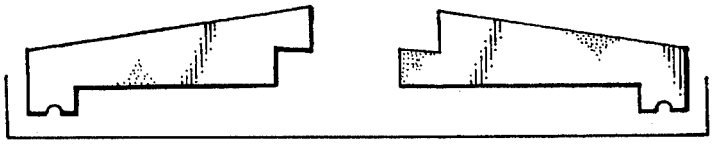
FIG. 10 is an exploded end view of FIG. 9.

As with all types of open top walls made from concrete, the walls of this invention should have a cap to prevent dirt, debris, and water from entering the wall structure. Such a cap can be for example the cap 33 shown in FIGS. 9 and 10.

What has been described is a novel sound collecting block, a connector block and solid wall blocks which can be used to create a sound absorbing wall, or a retaining wall having an aesthetic appearance, but being stable and easy to assemble.

We claim:

1. A sound collecting block of solid molded structural material having a front surface which has a horizontal midline, a rear surface, two essentially identical end surfaces, a top surface, and a bottom surface;

said top surface having a planar notch therein, extending from the front surface to the rear surface thereof;

said sound collecting block containing a plurality of vertical slots extending between the front surface and the rear surface, said vertical slots extending from about the horizontal midline of the front surface, to and communicating with, the planar notch;

each said end surface having a vertical midline, and located at the vertical midline, a vertical well which extends between the top surface and the bottom surface of the block.

2. A sound collecting block as claimed in claim 1 in which there are at least four vertical slots.

3. A sound collecting block as claimed in claim 1 in which there are at least six vertical slots.

4. A connector block, said connector block having two essentially identical end walls and two identical side walls which are formed contiguously to provide a central open chamber in the connector block;

said side walls having a top surface with a midpoint and an inner surface and an outer surface, and a bottom surface;

each said side wall having a groove through its top surface, at about its midpoint extending between the inner surface and the outer surface;

said outer surface of each side wall having two vertical wells therein, said wells located equidistant from the midpoint of the top surface and near the end walls of the connector block and extending between the bottom surface of the sidewall and the top surface of the sidewall.

5. A sound absorbing wall segment comprising in combination:

(I) a block of claim 1 as a front, sound collecting wall block;

(II) a block of solid molded structural material as a back, non-sound collecting wall block; and, (III) a block of solid molded structural material as a connector block to mechanically connect the front block and the back block together to provide a sound absorbing wall segment, said connector block having two essentially identical end walls and two essentially identical side walls, all of which are formed contiguously to provide a central open chamber in the connector block; said side walls having a top surface with a midpoint and an inner surface and an outer surface, and a bottom surface;

each said side wall having a groove through its top surface, at about its midpoint, extending between the inner surface and the outer surface;

said outer surface of each side wall having two vertical wells therein, said wells located equidistant from the midpoint of the top surface and near the end walls of the connector block and extending between the bottom surface of the sidewall and the top surface of the sidewall.

6. A sound absorbing wall comprising in combination, two or more sound absorbing wall segments of claim 5.

7. A retaining wall segment comprising in combination:

(A) a block of solid molded structural material as a front block;

(B) a block of solid molded structural material as a back block and (C) a block of claim 4 as a connector block to connect the front block and the back block together to provide a retaining wall segment.

8. A retaining wall comprising in combination, two or more retaining wall segments of claim 7.

9. A sound absorbing retaining wall comprising at least one sound absorbing wall segment of claim 7 in combination with at least one retaining wall segment comprising in combination:

(i) a block of solid molded structural material as a front block;

(ii) a block of solid molded structural material as a back block and (iii) a connector block to connect the front block and the back block together to provide a retaining wall segment.

10. A turning block, said turning block having two essentially identical end walls with a top surface, a bottom surface, and a midpoint, two essentially identical side walls, and a middle wall with a top surface, which are formed contiguously to provide two central open chambers in the connector block;

said side walls having a top surface with a midpoint and an inner surface and an outer surface, and a bottom surface;

each said side wall having a groove through its top surface, at about its midpoint extending between the outer surfaces of the side walls, and laying on the top surface of the middle wall;

said outer surface of each side wall having two small vertical wells therein, said small vertical wells located equidistant from the midpoint of the top surface and near the end walls of the connector block and extending between the bottom surface of the sidewall and the top surface of the sidewall and, each outer surface of each side wall having one large vertical well therein, each said large vertical well centered between the respective small vertical wells therein and extending between the bottom surface of the sidewall and the top surface of the sidewall and, each end wall having two end vertical wells therein, said end vertical wells being spaced apart and located near each other at the midpoint of the end wall so as to form a vertical column between them, each said end wall vertical column extending between the bottom surface of the end wall and the top surface of the end wall.

* * * * *